United States Patent [19]

Annand

[11] 4,326,631

[45] Apr. 27, 1982

[54] RIGID INSULATION ASSEMBLY

[76] Inventor: Charles A. Annand, P.O. Box 366, Truro, Nova Scotia, Canada, B2N 5C5

[21] Appl. No.: 77,764

[22] Filed: Sep. 21, 1979

[51] Int. Cl.[3] ..... B65D 85/66

[52] U.S. Cl. ..... 206/389; 206/417; 52/127; 52/631

[58] Field of Search ..... 52/173 R, 127, 749, 52/746, 747, 631, 408, 406, 409, 309.9, 411, 412; 206/412, 323, 324, 321, 417, 389; 156/71

[56] References Cited

U.S. PATENT DOCUMENTS

| | | | |
|---|---|---|---|
| 3,084,403 | 4/1963 | Elmendorf | 52/99 X |
| 3,958,385 | 5/1976 | Bondra, Jr. et al. | 52/631 X |
| 4,021,981 | 5/1977 | Van Wagoner | 156/71 X |
| 4,078,355 | 3/1978 | Clemensen | 52/749 X |

FOREIGN PATENT DOCUMENTS

| | | | |
|---|---|---|---|
| 640458 | 3/1964 | Belgium | 52/309.9 |

*Primary Examiner*—Price C. Faw, Jr.
*Assistant Examiner*—Carl D. Friedman
*Attorney, Agent, or Firm*—Mason, Fenwick & Lawrence

[57] ABSTRACT

A rigid insulation assembly including a plurality of panels of rigid insulation fixed in edge-to-edge relationship on a top base sheet to form a continuous length of insulation material wound on a core member whereby the insulation may be readily handled and be quickly applied to a roof deck by unrolling the material. The core is of polygonal cross-section so as to define a plurality of faces about its periphery, and the panels in the innermost layer on the core are of substantially the same width as the faces with the panels in each successive layer outwardly from the innermost layer having progressively greater widths so that the joint lines between adjacent panels are located substantially on radial lines passing through the corner edges between the faces of the core. Accordingly, the panels in the first layer lie flatly against the core and the panels in each successive layer lie flatly against the panel in the layer inwardly therefrom so that there is no danger of the panels being torn away from the base sheet because of a rolling effect. The panels have one edge with a convex cross-section whereas its other edge is concave in shape so as to receive the convex edge of the adjacent panel and form a V-joint which provides better insulating characteristics, and the interlock between the panels provides a stronger structure. A vapor barrier sheet has an inside surface fixed to the bottom surfaces of the panel and extends the length of insulation material.

11 Claims, 6 Drawing Figures

RIGID INSULATION ASSEMBLY

This invention relates to a rigid insulation material, and more particularly to an assembly which permits a continuous length of insulation to be rapidly applied to a roof deck.

It is common practice to adhere or otherwise fasten large rectangular sheets of rigid insulation on a roof deck. Roofing felt is adhered to the top surface of the rigid insulation and the exterior surface of the roof is poured onto the felt. Since the sheets of insulation are laid individually the installation of the insulation is a time consuming job, and care must be taken to insure that each sheet tightly abuts the adjacent sheet to prevent heat loss. Under windy conditions the large light sheets are extremely difficult to maneuver.

It is usually the practice to deliver the required supply of sheets of insulation to a building site prior to the roofing operation, and it is not uncommon for a contractor to experience a considerable loss before the insulation is utilized. The sheets are readily damaged if struck by another object and are easily blown about due to their shape and low density. The sheets are also susceptible to thievery from the building site due to their lightness in weight.

Although it has been previously proposed that strips of insulation could be fixed to a continuous membrane to form a laminate of rigid insulation and membrane which could be wound onto a roll, it is believed that it has not been accepted commercially because of the tendency of the insulation to depart from the membrane when the roll was being formed, handled and unrolled. Additionally, in the previous proposal good insulating characteristics were not maintained in view of the heat loss through the slots between adjacent strips of insulation.

It is an object of the present invention to provide a rigid insulation applying assembly which facilitates the handling and laying of rigid insulation and yet provides good insulating characteristics.

According to the present invention there is provided a rigid insulation applying assembly having an elongated core member with the central axis and a continuous length of insulating material wound on the core member and including a flexible base sheet and plurality of rigid insulating panels adhered to the base sheet. The panels have top and bottom surfaces, and the flexible base sheet is adhered to the top surface of the panels, each panel having side edges and being disposed in edge-to-edge relationship with adjacent panels to form joint lines extending transfers to the length of material. The base sheet is in contact with the core in the innermost layer wound on the core member and a vapour barrier sheet is provided which has an inside surface fixed to the bottom surfaces of the panels and extending the length of the insulation material.

One side edge of each panel may be of convex shape and the other may be of concave shape for receiving the convex shape of the side edge of an adjacent panel so that the panels interlock when the insulation material is laid flat on the roof deck.

The vapour barrier sheet may be provided with a transverse pleat at each joint line, the pleat projecting into the space between the adjacent edges of the panels in the assembly so that a tuck is formed between the edges when the panels are laid flat on a roof deck.

Referring now to the drawings, which show one embodiment of the present invention, by way of an example:

Figure 3:
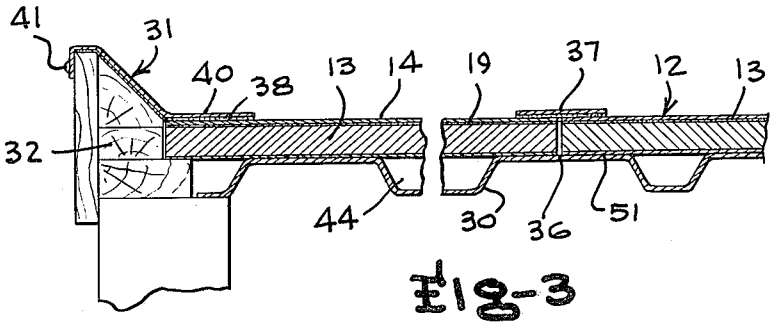
FIG. 3 is a view similar to that of FIG. 2 but as seen at right angles thereto.

The reference numeral 10 generally denotes the rigid insulation applying assembly of the present invention, and it includes a mandrel or core 11 with a continuous length of insulation material 12 wound on the core. The insulation material 12 is made up of a number of panels 13 of rigid insulation board adhered to a continuous length of flexible material forming base sheet 14 which may be a heavy felt or other moisture impervious material.

The core 11 is an elongated member having a plurality of flat faces 15 formed around its periphery, adjacent faces being joined along common edge corners 16. The core may be formed of a suitable material and for the sake of economy and weight it is preferably a hollow body. It may be formed for example by securing a number of plywood side sheets 17 to a pair of end plates 18. The outer periphery of the unit may be covered with a galvanized sheet metal skin (not shown). A tubular member 20 extends through the end plates along the axis 21 of the core. The faces 15 and corners 16 extend the length of the core in parallel relationship to the axis 21 so that the core has a constant polygonal shape in cross-sectional through its length. The cross-sectional shape of the core is shown as hexagonal, as this appears to be the most feasible shape, although it is apparent that the core could have more or less sides. The faces 15 are of the same width, but preferably face 15*a* is slightly longer for reasons which will subsequently become apparent.

When manufacturing the insulating material 12, the panels, which will occupy the first layer or innermost about the core, are cut to a width substantially equal to the width of the faces 15 of the core 11, and the panels for each successive layer are cut progressively wider so that as the layers are wound onto the core the joint lines between adjacent panels are located substantially on radial lines which project through the edge corners 16 of the core 11.

In production of the insulation material 12, rigid insulation boards may be fed by a conveyor one after another through a cutting station wherein saws or other cutting devices are programmed to cut transversely of the boards to provide an output of panels having the appropriate sets of widths which progressively increase as described above. Preferably each transverse cut is made by a pair of saws (not shown) one above the insulation board and one below, the saws being disposed at an oblique angle to the top and bottom surfaces of the insulation board so that a V-shaped cut is provided. The cut panels are then fed in close edge-to-edge abutting relationship to a station wherein the base sheet is fed onto the top of the panels, the surface of this base sheet which comes into contact with the panels first be treated with an adhesive 19 or a hot asphalt. The base sheet and panels are then pressed firmly together and wound onto the core 11.

The base sheet 14 is equal in width to the length of the panels so as to completely cover the panels when the panels are laid on a surface to be covered. In length the base sheet 14 is longer than the sum of the widths of all of the panels in a single assembly so that the base sheet is provided with tail ends 23 and 24. The first panel 13*a* and the last panel 13*z* in the continuous length of insulation material 13 have the side edges 25 and 26, respectively, which are remote from the panels in the length, i.e. the first and last edges of the panels, and are square-edged rather than V-shaped for reasons which will become apparent below.

As mentioned above, the panels 13 in the innermost layer are substantially equal in width to the faces 15 of the core. Also as mentioned above the face 15*a* may be slightly larger than the others so that the first panel 13*a* would be of slightly less width than the face. Panel 13*f* which is the sixth panel in the inner layer is slightly greater in width than the face of the core against which it rests so that it projects past edge 25 of panel 13*a* to panel 13*g* which is the first panel in the second layer about the core.

Figure 4:
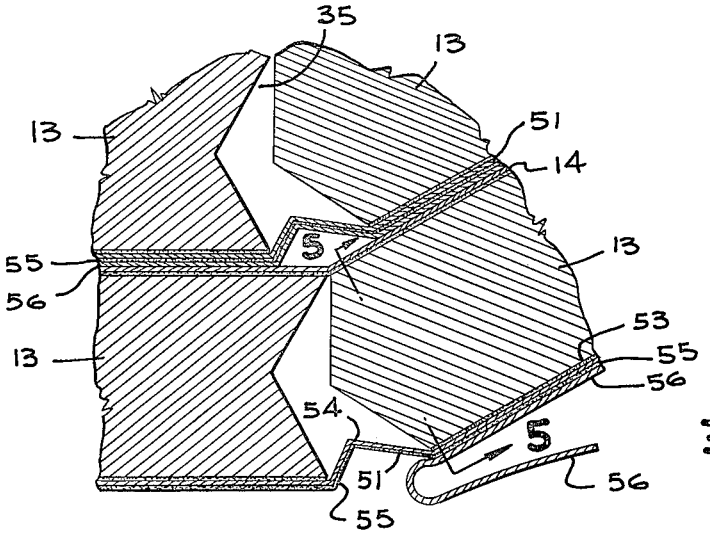
FIG. 4 is a partial enlarged end view of the assembly of the invention showing the relationships of the vapour barrier sheet to the other elements in the assembly.
Figure 6:
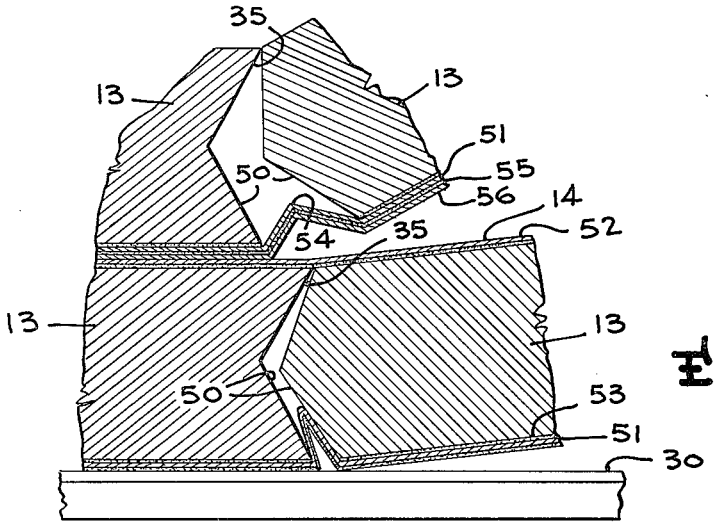
FIG. 6 is an enlarged edge view of the insulation material and showing the relationship of the vapour barrier thereto as the insulation material is laid into position.
Figure 5:
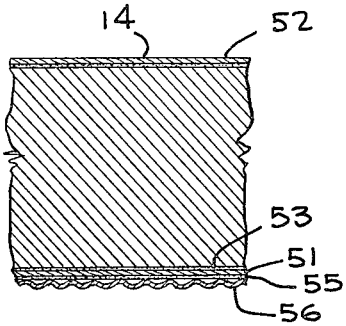
FIG. 5 is a section view as seen from the line V—V of FIG. 4.

When wound upon the core the adjacent side edges 50, 50 of the panels diverge as shown in FIG. 4 and the edges abut when the panels are laid flat on a roof deck.

A vapour barrier sheet 51, which is preferable in the form of a continuous sheet of plastic of the same width as the base sheet 14 is fixed to the bottom surface 53 of the panels 13. At each joint line 35, the vapour barrier sheet 51 is provided with a tuck 54 which extends transversely of the sheet and projects into the space between diverging side edges 50,50 of the panels as they exist when the insulation material is wound on the core.

A coating of adhesive 55 may be applied to the outside surface of the vapour barrier sheet 51, and a removable layer of waxed paper 56 covers or masks the adhesive 55 so that it is maintained in a semi-liquid state. The waxed paper 56 is corrugated in the direction of the length of insulation material so that it does not become excessively pressed into the adhesive 55 when the insulation material is wound on the core, stored and handled prior to installation.

In production, the sheet of vapour barrier material may be fed from a roll onto the insulation material as it is being wound onto the core, an adhesive 58 being applied to the inside surface of the sheet prior to the sheet contacting the insulation material for adhering vapour barrier sheet to the bottom of the panels 13. Simultaneously the continuous length of waxed paper is pulled from a separate roll and the adhesive 55, which will remain on the outside surface of the vapour barrier sheet is fed onto the inside of the waxed paper prior to being brought into contact with the outside of the vapour barrier sheet and the waxed paper and vapour barrier sheet, with the adhesive 55 sandwiched therebetween are brought against the panels so that the vapour barrier sheet is adhered to the insulation material during winding as just described above. As the insulation material is wound on the core the space between the side edges 50,50 of the panels 13 opens and a striker bar is brought into engagement with the waxed paper sheet and vapour barrier sheet to form the pleat 54.

Although reference has been made to the sheet which covers adhesive 55 as being waxed paper, it is apparent that alternatives, such as plastic film or paper having a plastic coating, could be utilized.

Figure 2:
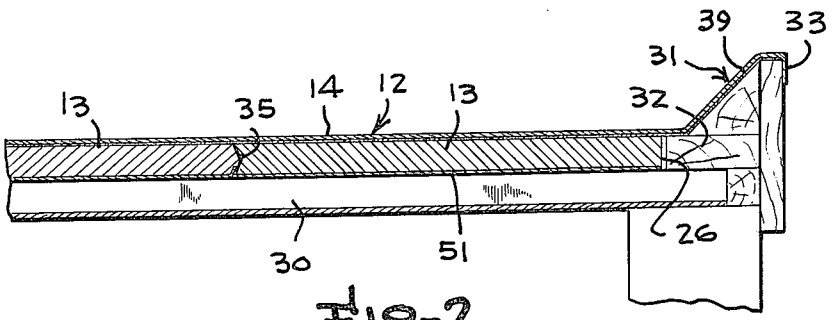
FIG. 2 shows a section through a roof structure on which the insulating material has been installed.
Figure 1:
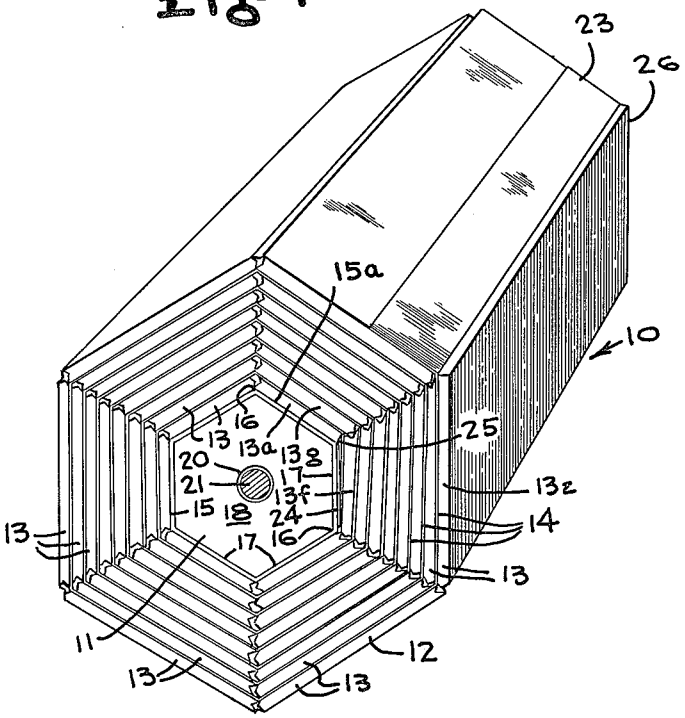
FIG. 1 is a perspective view of the rigid insulation applying assembly.

When the assembly 10 has been formed it may be inserted in a polyethylene bag and possibly steel strapping may be wrapped therearound before it is shipped to the building site. The insulation material 12 is thus protected against being blown about and may not be readily stolen. The complete assembly may be conveniently shipped and stored. The assembly may be unwound directly on the roof deck to be covered, which may be, for example, a corrugated steel roof structure 30, commonly known as a Q-Deck. Starting at the roof curb or edge 31, the square edge 26 is placed tightly against a wood roof stop 32, and the tail end is extended over adhesive 39 on the roof edge 31 and nailed at 33. The assembly is then unrolled across the roof structure 30. A wheeled carriage (not shown) may be provided for carrying the assembly and permitting it to unwind, the tube 20 providing an axle about which the assembly can rotate. The carriage may include wheels which ride on the unrolled insulation material so as to press the insulation material onto hot asphalt or other adhesive material which may have been spread on the roof structure 30, particularly if the vapour barrier is not provided with an adhesive. As the panels 13 assume the flat positions as shown in FIGS. 2 and 3 the edges of the panels close to form light, interlocking V-shaped joints 35 as shown in FIG. 2. When one length of insulation material 12 has been completely unwound, another length is started by abutting the square-edged panel 13*z* of a fresh assembly against the square-edged panel 13*a*, i.e. edge 26 against 25, and one of the tail ends 23,24 is used to overlap the joint. The continuous lengths of insulation material 12 are laid side-by-side so that square-shaped joints 36 are formed therebetween (FIG. 3), and the joints 36 may be covered with a tape 37. Along the side edges of the lengths of insulation material which abut the roof edge, the insulation material has a strip of roofing sheet 40 adhered by adhesive 38 to the top thereof, and the roofing sheet 40 is passed over the edge and nailed at 41. Additional roofing sheets (not shown) are then built up on top of the laid insulation material and the roof is then completed in the conventional manner.

It is believed apparent that in the assembly 10, the panels 13 would remain tightly secured to the base sheet 14 in view of the manner in which the panels lay flatly on each other. The insulation material can be quickly applied to the roof structure as compared to conventional methods of laying individual sheets of rigid insulating boards, and factors such as wind are not important. The V-shaped joints prevent heat loss as compared to that which takes place with square-edged joints and also impedes moisture migration to the bottom side of the roof membranes which are laid on top of the insulation material. The interlock which is provided between the panels by the V-shaped joints also restrains wind or other uplift forces, and the interlock also provides the roof with greater load carting ability which is particularly important over open valley 44 in a Q-Deck structure.

It may not be necessary to spread any additional adhesive onto the structure prior to laying the insulation material when the adhesive is provided on the underside of the vapour barrier. As the insulation material is being unwound the waxed paper is stripped so as to expose adhesive 55. As the insulation material is pressed against the roof structure, the adhesive 55 is brought into contact with the roof structure so as to adhere the insulation material to the roof, and as panels 13 are laid flat the pleat 54 forms a tuck which is pinched between the side edges 50,50 of the panels. Thus the insulation material may be installed with a minimum of labour and additional materials, and additionally a superior roof structure is provided.

Although specific embodiments of the invention have been illustrated in the drawings and described above it will be apparent to those skilled in the art the various modifications that could be made without departing from the spirit of the invention as defined in the appending claims.

The embodiments of the invention in which an exclusive property of privilege is claimed are defined as follows:

1. A rigid insulation assembly comprising an elongated core member having a central axis and a continuous length of insulation material wound on said core member, said core member having a periphery thereof formed by a plurality of flat faces, adjacent faces about the periphery being joined at corners extending parallel to the axis of the core member so that the core through the length thereof has a constant polygonal shape in cross-section, the continuous length of insulation material including a flexible base sheet and a plurality of rigid insulating panels adhered to said base sheet, having top and bottom surfaces, said flexible base sheet being adhered to the top surface of said panels, each panel having side edges and being disposed in an edge to edge relationship with adjacent panels to form joint lines extending transverse to the said length of material, said base sheet being in contact with said core and the innermost layer wound on said core member, the panels in the innermost layer being substantially equal in width to the faces of the core against which said panels lie, the panels in each successive layer outwardly from the innermost layer having progressively greater widths whereby the joint lines are located substantially on radial lines projecting through said corner edges of said core, and a vapour barrier sheet having an inside surface fixed to the bottom surfaces of said panel and extending the length of said insulation material.

2. An assembly as defined in clam 1, wherein the adjacent side edges of said panels in said assembly diverge from said top to said bottom surfaces of said panels, and wherein said vapour barrier sheet is provided with a transverse pleat at each joint line, said pleat projecting between said adjacent side edges of said panels whereby tucks of said vapour barrier sheet are received between abutting edges of said panels when said panels are laid flat.

3. An assembly as defined in claim 1, wherein said vapour barrier sheet is fixed to said bottom surface of said panels by an adhesive between said inside surface of said vapour barrier sheet and said bottom surfaces of said panels.

4. An assembly as defined in claim 1, and further comprising an adhesive applied to an outside surface of said vapour barrier sheet.

5. An assembly as defined in claim 4, and further comprising a cover sheet of waxed paper removably fixed to said outside surface of said vapour barrier sheet for masking said adhesive.

6. An assembly as defined in claim 5, wherein said paper is corrugated lengthwise of said insulating material.

7. A rigid insulation assembly comprising an elongated core member having a central axis and a continuous length of insulation material wound on said core member and including a flexible base sheet and a plurality of rigid insulating panels adhered to said base sheet, having top and bottom surfaces, said flexible base sheet being adhered to the top surface of said panels, each panel having side edges and being disposed in edge-to-edge relationship with adjacent panels to form joint lines extending transverse to the said length of material, said base sheet being in contact with said core in the innermost layer wound on said core member, a vapour barrier sheet having an inside surface fixed to said bottom surfaces of said panel and extending the length of said insulation material, the adjacent side edges of said panels in said assembly diverging from said top to said bottom surfaces of said panels, said vapour barrier sheet being provided with a transverse pleat at each joint line, said pleat projecting between said adjacent side edges of said panels in the assembly whereby tucks of said vapour barrier sheet are pinched between abutting edges of said panels when said panels are laid flat.

8. An assembly as defined in claim 7, wherein said vapour barrier sheet is fixed to said bottom surface of said panels by an adhesive between said inside surface of said vapour barrier sheet and said bottom surfaces of said panels.

9. An assembly as defined in claim 7, and further comprising an adhesive applied to an outside surface of said vapour barrier sheet.

10. An assembly as defined in claim 9, and further comprising a cover sheet of waxed paper removably fixed to said outside surface of said vapour barrier sheet for masking said adhesive.

11. An assembly as defined in claim 10, wherein said paper is corrugated lengthwise of said insulating material.

* * * * *